US006942168B2

(12) United States Patent
Rance et al.

(10) Patent No.: US 6,942,168 B2
(45) Date of Patent: Sep. 13, 2005

(54) SPRAY NOZZLE SUITABLE FOR USE IN HOT CORROSIVE ENVIRONMENTS AND METHOD OF USE

(75) Inventors: Trent Rance, Battle Ground, WA (US); Chris Warberg, Vancouver, WA (US)

(73) Assignee: WaferTech, LLC, Camas, WA (US)

( * ) Notice: Subject to any disclaimer, the term of this patent is extended or adjusted under 35 U.S.C. 154(b) by 135 days.

(21) Appl. No.: 10/385,589

(22) Filed: Mar. 11, 2003

(65) Prior Publication Data

US 2004/0195379 A1 Oct. 7, 2004

(51) Int. Cl.[7] ..... A62C 31/02; B05B 1/00; B05B 1/04

(52) U.S. Cl. ..... 239/589; 239/590.5; 239/592; 239/593; 239/594; 239/595

(58) Field of Search ..... 239/589, 590.5, 239/592, 593, 594, 595, 302, 307, 308, 310, 548, 550, 553.5, 556

(56) References Cited

U.S. PATENT DOCUMENTS

| | | | | | |
|---|---|---|---|---|---|
| 3,770,205 | A | * | 11/1973 | Proctor et al. | 239/317 |
| 3,876,150 | A | * | 4/1975 | Dwyer et al. | 239/424 |
| 3,905,554 | A | * | 9/1975 | Bell | 239/424 |
| 3,908,651 | A | * | 9/1975 | Fudge | 604/71 |
| 4,060,201 | A | | 11/1977 | Tomita | |
| 4,208,192 | A | | 6/1980 | Quigley et al. | |
| 4,349,157 | A | * | 9/1982 | Beiswenger et al. | 239/509 |
| 4,475,689 | A | * | 10/1984 | Hauger et al. | 239/318 |
| 4,646,991 | A | | 3/1987 | Kranz | |
| 5,050,800 | A | | 9/1991 | Lamar | |
| 5,152,458 | A | | 10/1992 | Curtis | |
| 5,158,231 | A | | 10/1992 | Christen et al. | |
| 5,381,959 | A | * | 1/1995 | Malkin | 239/201 |
| 5,687,914 | A | | 11/1997 | Bosio et al. | |
| 6,036,118 | A | | 3/2000 | Walker et al. | |
| 6,082,465 | A | | 7/2000 | Retzloff | |
| 6,098,718 | A | | 8/2000 | Sato | |
| 6,158,675 | A | | 12/2000 | Ogi | |
| 2001/0054508 | A1 | | 12/2001 | Fischer et al. | |

* cited by examiner

*Primary Examiner*—Davis Hwu
(74) *Attorney, Agent, or Firm*—Duane Morris LLP

(57) ABSTRACT

A spray nozzle for spraying a fluid and suitable for use in hot corrosive environments is disclosed, comprising a single piece body comprising a top and a bottom disposed opposite the top where the bottom further comprises a connector; a channel disposed about an outer portion of the single piece body intermediate the bottom and the top, the channel extending from the outer portion of the single piece body and terminating at an interior wall; and a fluid passageway in fluid communication with the bottom and with the channel. The channel may disperse fluid at a predetermined angle defined by the outer portion of the single piece body and the interior wall of the channel with respect to an axis defined by the fluid passageway. It is emphasized that this abstract is provided to comply with the rules requiring an abstract which will allow a searcher or other reader to quickly ascertain the subject matter of the technical disclosure. It is submitted with the understanding that it will not be used to interpret or limit the scope or meaning of the claims.

20 Claims, 3 Drawing Sheets

SPRAY NOZZLE SUITABLE FOR USE IN HOT CORROSIVE ENVIRONMENTS AND METHOD OF USE

FIELD OF INVENTION

The present invention relates to an apparatus suitable for dispersing a fluid into an environment and its method of use.

BACKGROUND OF THE INVENTION

Current nozzle spray practice directs a spray of fluids in direction opposite fluid supplied to the nozzle by using U-shaped tubing. Use of such tubing may interfere with a spray pattern of fluid exiting the nozzle. A disadvantage of such approaches is that a substantial portion of the fluid spray discharges from a lower portion of the nozzle, leaving the top portion of the nozzle exposed to the environment, e.g. a corrosive environment. Such exposure may shorten the useful life of the nozzle, e.g. exposure to heat and other environmental factors may accelerate corrosion, metal fatigue, etching, and other premature nozzle failures.

Further, the spray nozzle tubing may penetrate through fluid spray pattern, thereby obstructing a desired spray pattern such as a full circular pattern. Obstruction may allow heat and particulate through the gap created by the obstruction. This may further promote failure of tubing connected to the nozzle, especially if the tubing is supply tubing located above the nozzle.

Often, nozzles have one or more welds. Welds are a further source of premature failure of the nozzle, especially in hot, corrosive environments.

DETAILED DESCRIPTION OF THE PREFERRED EMBODIMENT

Figure 1C:
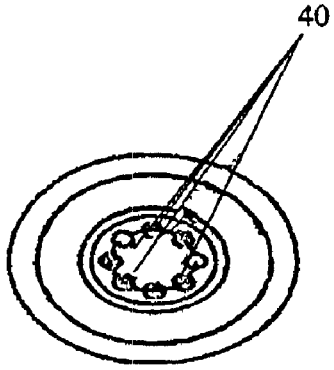
FIG. 1*c* is a bottom view of an embodiment of a nozzle illustrating a plurality of fluid passageways.
Figure 1A:
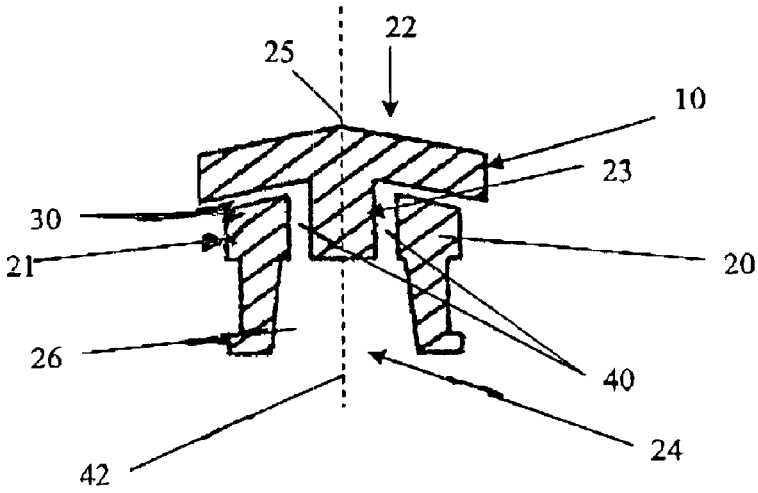
FIG. 1*a* is a cutaway side view of an embodiment of a nozzle illustrating fluid passageways in communication with a channel.
Figure 1B:
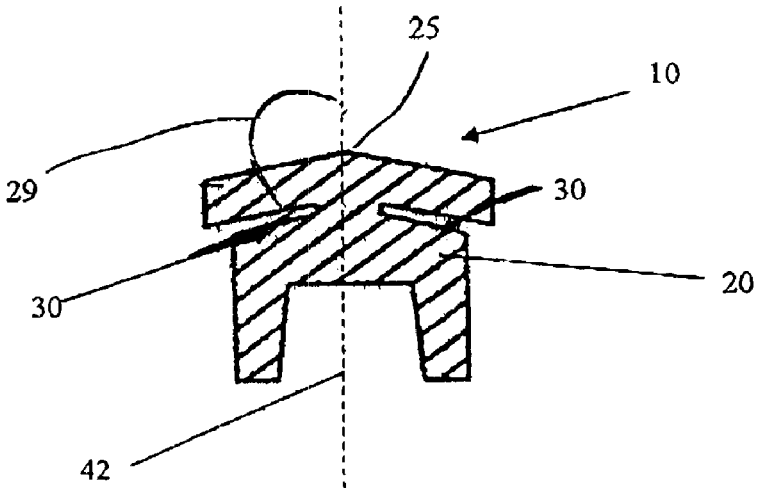
FIG. 1*b* is a cutaway side view of an embodiment of a nozzle.

Referring now to FIG. 1*a*, a cutaway side view of an embodiment of a nozzle illustrating fluid passageways in communication with a channel, and FIG. 1*b*, a cutaway side view of an embodiment of a nozzle, nozzle 10 is useful for spraying a fluid such as water and may especially be useful when deployed in hazardous or corrosive environments.

Nozzle 10 comprises single piece body 20, channel 30, and fluid passageway 40. In a preferred embodiment, nozzle 10 is fabricated without welds. Further, nozzle 10 may be spool machined from a HASTELLOY metal, machined from a material suitable for use in a hazardous environment, machined from a material suitable for use in a non-corrosive environment, machined from a material suitable for use in a corrosive environment, machined from a material suitable for use in a hot corrosive environment, or the like, or a combination thereof HASTELLOY may be obtained from Haynes International, Inc., Kokomo Ind. By way of example and not limitation, nozzle 10 may comprise a metal such as stainless steel, brass, aluminum, titanium, or the like; INCONEL from Inco Alloys International, Inc., Huntington, W. Va.; fluoroplastics such as polytetrafluorethylene ("PTFE") or polyvinylidene fluoride ("PVDF"); other plastics such as polypropylene, polyethylene, polyvinylchloride, or chlorinated-polyvinylchloride; or the like; or a combination thereof.

Single piece body 20 comprises top 22 and bottom 24 disposed opposite top 22. In an embodiment, top 22 has a substantially conical shape whose apex 25 is disposed opposite bottom 24. In currently envisioned alternative embodiments, top 22 may be substantially flat or substantially convex. Bottom 24 may further comprise connector 26. Connector 26 may be a male threaded connector, a female threaded connector, a quick disconnect coupler, a compression fitting, an NPT threaded connector, a face-seal connection, or the like.

Channel 30 is disposed about a predetermined outer portion of single piece body 20 intermediate bottom 24 and top 22. Channel 30 extends from outer portion 21 of single piece body 20 and terminates at interior wall 23 defined by fluid passageway 40. Channel 30 may be a single channel partially in circumference about single piece body 20, a single channel fully in circumference about single piece body 20, a plurality of channels disposed about outer portion 21 of single piece body 20, or the like. Additionally, each such channel 30 may be rectangular, obround, circular, oval, star-shaped, or any other shape desired. Channel 30 may be circumferential, parallel to axis 42, or the like, or a combination thereof.

Fluid passageway 40 is in fluid communication with bottom 24 and with channel 30. In a preferred embodiment, channel 30 is further aligned at a predetermined angle 29 (FIG. 1*b*) defined by channel 30 with respect to axis 42. In this manner, fluid may be dispersed through channel 30 at predetermined angle 29. In a preferred embodiment, predetermined angle 29 directs fluid from first fluid passageway 40 through channel 30 at an angle of between 0° and 180°, and more preferably 90° and 180°, with respect to axis 42.

As illustrated in FIG. 1*c*, in a preferred embodiment, fluid passageway 40 may comprise a plurality of fluid passageways 40. In such embodiments, the plurality of fluid passageways 40 may further be arranged in a predetermined pattern, e.g. a circular pattern, a centered spray pattern, or the like.

Figure 2:
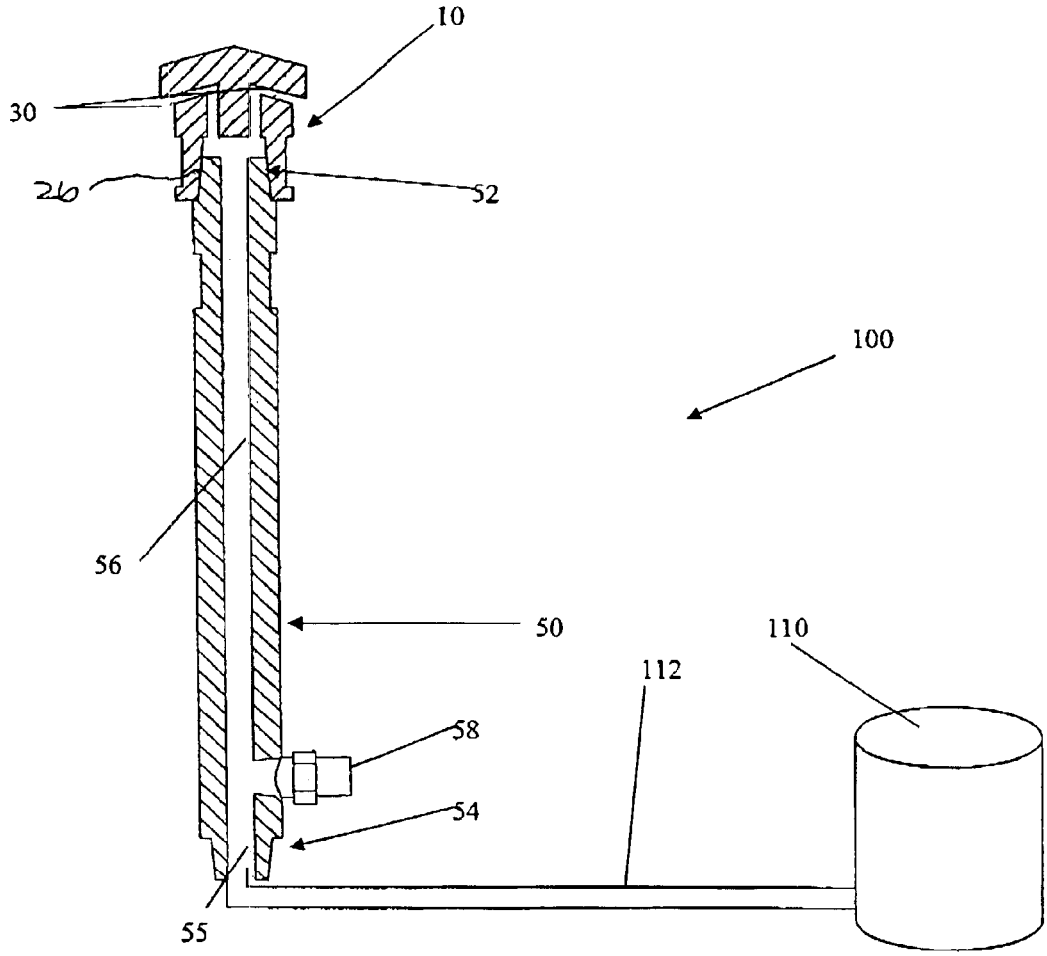
FIG. 2 is a cutaway view of an exemplary nozzle and body and a partial schematic view of a system incorporating a nozzle.

Referring now to FIG. 2, spray system 100, for spraying a fluid, comprises nozzle 10 and fluid chamber 50. Fluid chamber 50 further comprises first end 52 adapted to engage and be secured with connector 26 of nozzle 10. Fluid chamber 50 further comprises second end 54, fluid chamber fluid passageway 56, and fluid inlet 55 in fluid communication with fluid chamber fluid passageway 56. Fluid chamber fluid passageway 56 is disposed within the fluid chamber and is in fluid communication with fluid passageway 40 of nozzle 10.

Fluid chamber 50 may be of any desired shape but, in a preferred embodiment, is substantially tubular. In certain embodiments, secondary spray nozzle 58 may be present and in fluid communication with fluid chamber fluid passageway 56. Secondary spray nozzle 58 may act as a secondary quench spray.

Source 110 of fluid is in fluid communication with fluid inlet 55 such as by hose 112 or other conduit 112 or directly attached such as to a tank, e.g. source 110.

Figure 3:
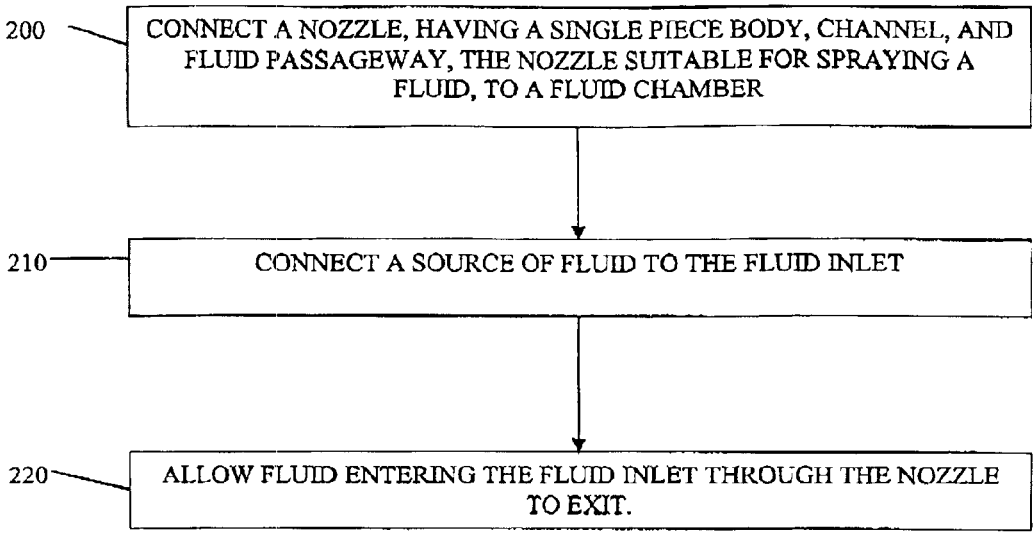
FIG. 3 is a flowchart of a method of using the nozzle.

In the operation of an exemplary embodiment, referring now to FIG. 3, fluid may be sprayed into an environment by connecting, at step 200, nozzle 10 (FIG. 2), which is suitable for spraying a fluid, to fluid chamber 50. Fluid source 110 (FIG. 2) may be connected to fluid inlet 55 (FIG. 2), at step 210. It is understood that these steps do not have to occur in any particular sequence and that other components may be part of system 100 (FIG. 2), e.g. valves, limiters, controllers, and the like.

Fluid may be allowed to enter fluid inlet 55 (FIG. 2) and pass through channel 30 (FIG. 2) in nozzle 10 (FIG. 2) to exit. Via nozzle 10, fluid may be sprayed in a pattern such as a circular pattern, a centered spray pattern, or the like. As it exits channel 30, fluid exiting channel 30 may be used as an aid in reducing exposure of outer surface 21 (FIG. 1*a*) of nozzle 10 from the environment into which nozzle 10 is introduced. Nozzle 10 (FIG. 2) may be deployed to spray a fluid into a non-corrosive environment, a corrosive environment, a hot corrosive environment, or the like, or a combination thereof.

The fluid may comprise an acidic fluid, a basic fluid, or a pH neutral fluid. In a preferred embodiment, fluid is water. In an embodiment, fluid supplied to system 100 (FIG. 2) is supplied from a first direction, e.g. from second end 54 towards first end 52 in FIG. 2, and sprayed in a second direction which is substantially deflected at an angle relative to the first direction in a predetermined plane, e.g. opposite or outward and/or downward at an angle with respect to axis 42 in FIG. 1*a*, without interruption of the spray pattern by nozzle 10. By way of example and not limitation, fluid entering fluid chamber 50 (FIG. 2) may be routed without obstruction and fluid spray from channel 30 (FIG. 2) dispersed at a second predetermined angle, e.g. 135° with respect to axis 42 (FIG. 1*a*).

In certain embodiments, secondary spray nozzle 58 may be used as a secondary quench spray. After exhaust gases (not shown in the figures) flow down and past nozzle 10, the exhaust gasses may make a turn at an angle, e.g. 90°, and flow concurrently with fluid spraying from secondary spray nozzle 58.

It will be understood that various changes in the details, materials, and arrangements of the parts which have been described and illustrated above in order to explain the nature of this invention may be made by those skilled in the art without departing from the principle and scope of the invention as recited in the appended claims.

We claim:

1. A nozzle for spraying a fluid, comprising:

a. a single piece body, further comprising:

1) a top; and 2) a bottom disposed opposite the top, the bottom further comprising a connector;

b. a channel disposed about an outer portion of the single piece body intermediate the bottom and the top, the channel extending from the outer portion of the single piece body and terminating at an interior wall; and c. a fluid passageway in fluid communication with the bottom and with the channel, the channel further aligned at a predetermined angle defined by the outer portion of the single piece body and the interior wall of the channel with respect to a central, vertical axis parallel to the fluid passageway, the channel disposed to provide a substantially circumferential spray pattern with respect to the central, vertical axis.

2. The nozzle of claim 1, wherein:

a. the top is at least one of (i) a substantially conical top whose apex is disposed opposite the bottom, (ii) a substantially flat top, or (iii) a substantially convex top whose apex is disposed opposite the bottom.

3. The nozzle of claim 1, wherein:

a. the predetermined angle directs fluid from first fluid passageway through the channel at an angle of between 0° and 180° with respect to the central, vertical axis.

4. The nozzle of claim 1, wherein:

a. the predetermined angle directs fluid from the fluid passageway through the channel at an angle of between 90° and 180° with respect to central, vertical axis.

5. The nozzle of claim 1, wherein:

a. the nozzle is fabricated without welds.

6. The nozzle of claim 1, wherein:

a. the nozzle is spool machined from at least one of (i) a HASTELLOY metal, (ii) a material suitable for use in a hazardous environment, (iii) a material suitable for use in a non-corrosive environment, (iv) a material suitable for use in a corrosive environment, or (v) a material suitable for use in a hot corrosive environment.

7. The nozzle of claim 1, wherein:

a. the connector is at least one of (i) a male threaded connector, (ii) a female threaded connector, (iii) a quick disconnect coupler, (iv) a compression fitting, (v) NPT threads, or (vi) a face-seal connection.

8. The nozzle of claim 1, wherein:

a. the channel is at least one of (i) a single channel substantially in circumference about the body, (ii) a single channel fully in circumference about the body, or (iii) a plurality of channels disposed about the outer portion of the body.

9. The nozzle of claim 1, wherein:

a. the fluid passageway is a plurality of fluid passageways.

10. The nozzle of claim 9, wherein:

a. the plurality of fluid passageways are arranged in a predetermined pattern comprising at least one of (i) a circular pattern or (ii) a centered spray pattern.

11. The nozzle of claim 1, wherein said channel is at least substantially in circumference around said body and said fluid passageway comprises a plurality of fluid passage ways arranged in a circular pattern about said interior wall.

12. A spray system for spraying a fluid, comprising:

a. a nozzle for spraying a fluid, comprising:

1) a single piece body, further comprising:

1. a top; and 2. a bottom disposed opposite the top, further comprising a connector;

2) a channel disposed about a predetermined outer portion of the single piece body intermediate the bottom and the top, the channel extending from the outer portion of the single piece body and terminating at an interior wall; and 3) a fluid passageway in fluid communication with the bottom and with the channel, the channel further aligned at a predetermined angle defined by the outer portion of the single piece body and the interior wall of the channel with respect to a central, vertical axis parallel to the fluid passageway, the channel disposed to provide a substantially circumferential spray pattern with respect to the central, vertical axis; and b. a fluid chamber, comprising:

1) a first end, the first end adapted to engage and engaged with the connector of the nozzle;

2) a second end;

3) a fluid chamber fluid passageway, the fluid chamber fluid passageway being disposed within the fluid chamber, the fluid chamber fluid passageway being in fluid communication with the fluid passageway of the nozzle; and 4) a fluid inlet in fluid communication with the fluid chamber fluid passageway.

13. The system of claim 10, further comprising:

a. a source of fluid in fluid communication with the fluid inlet.

14. The system of claim 10, further comprising:

a. a secondary spray nozzle in fluid communication with the fluid chamber fluid passageway.

15. A method of spraying a fluid, comprising:

a. connecting a nozzle, suitable for spraying a fluid, to a fluid chamber, the nozzle comprising a single piece body further comprising a top and a bottom disposed opposite the top, the bottom further comprising a connector; a channel disposed about a predetermined outer portion of the single piece body intermediate the bottom and the top, the channel extending from the outer portion of the single piece body and terminating at an interior wall; and a fluid passageway in fluid communication with the bottom and with the channel, the channel further aligned at a predetermined angle defined by the outer portion of the single piece body and the interior wall of the channel with respect to a central axis parallel to the fluid passageway, the channel disposed to provide a substantially circumferential spray pattern with respect to the central, vertical axis; the fluid chamber comprising a first end adapted to engage and engaged with the connector of the nozzle; a second end; a fluid chamber fluid passageway dispose within the fluid chamber, the fluid chamber fluid passageway being in fluid communication with the fluid passageway of the nozzle; and a fluid inlet in fluid communication with the fluid chamber fluid passageway;

b. connecting a source of fluid to the fluid inlet; and c. allowing fluid entering the fluid inlet through the nozzle to exit.

16. The method of claim 15 wherein:

a. the nozzle is deployed to spray a fluid into at least one of (i) a non-corrosive environment, (ii) a corrosive environment, or (iii) a hot corrosive environment.

17. The method of claim 15, wherein:

a. the fluid is supplied from a first direction; and b. the fluid is sprayed in a second direction which is deflected an angle relative to the first direction in a predetermined plane without interruption of the spray pattern by the nozzle.

18. The method of claim 15, wherein:

a. the fluid comprises at least one of (i) an acidic fluid, (ii) a basic fluid, or (iii) a pH neutral fluid.

19. The method of claim 15, wherein:

a. the fluid is sprayed in a pattern comprising at least one of (i) a circular pattern or (ii) a centered spray pattern.

20. The method of claim 15, wherein:

a. fluid exiting the channel aids in reducing exposure of the outer surface of the nozzle from an environment into which the nozzle is introduced.

* * * * *

UNITED STATES PATENT AND TRADEMARK OFFICE

CERTIFICATE OF CORRECTION

PATENT NO. : 6,942,168 B2
DATED : September 13, 2005
INVENTOR(S) : Trent Rance and Chris Warberg It is certified that error appears in the above-identified patent and that said Letters Patent is hereby corrected as shown below:

Column 4,
Line 2, delete “first” and insert -- the --;
Line 8, insert -- the -- before “central”;

Column 5,
Lines 6 and 9, delete “10” and insert -- 12 --; and
Line 31, delete “dispose” and insert -- disposed --.

Signed and Sealed this

Seventh Day of February, 2006

JON W. DUDAS
*Director of the United States Patent and Trademark Office*